US005958513A

United States Patent [19]

Madrzak

[11] Patent Number: 5,958,513

[45] Date of Patent: Sep. 28, 1999

[54] APPARATUS AND METHOD FOR DIRECT OR INDIRECT APPLICATION OF A LIQUID OR PASTY MEDIUM ONTO A TRAVELING MATERIAL WEB, NOTABLY OF PAPER OR CARDBOARD

[75] Inventor: Zygmunt Madrzak, Heidenheim, Germany

[73] Assignee: Voith Sulzer Papiermaschinen GmbH, Heidenheim, Germany

[21] Appl. No.: 08/854,694

[22] Filed: May 12, 1997

[30] Foreign Application Priority Data

May 13, 1996 [DE] Germany ..... 196 19 250

[51] Int. Cl.[6] ..... B05D 1/00

[52] U.S. Cl. ..... 427/356; 118/118; 118/119; 118/123; 118/126; 118/413

[58] Field of Search ..... 118/118, 119, 118/123, 126, 413; 427/356

[56] References Cited

U.S. PATENT DOCUMENTS

| | | | |
|---|---|---|---|
| 3,245,378 | 4/1966 | Caple et al. | 118/126 |
| 4,966,093 | 10/1990 | Sommer | 118/126 |
| 5,005,515 | 4/1991 | Sollinger | 118/100 |
| 5,035,196 | 7/1991 | Mannio | 118/126 |
| 5,074,243 | 12/1991 | Knop et al. | 118/665 |
| 5,104,697 | 4/1992 | Heikkinen et al. | 427/356 |
| 5,439,520 | 8/1995 | Reich | 118/410 |
| 5,460,119 | 10/1995 | Maroszek | 118/244 |

FOREIGN PATENT DOCUMENTS

| | | |
|---|---|---|
| 137 837 | 3/1984 | European Pat. Off. . |
| 0 565 508 | 4/1992 | European Pat. Off. . |
| 0 561 757 | 3/1993 | European Pat. Off. . |
| 0 561 757 A1 | 9/1993 | European Pat. Off. . |
| 41 41 217 A1 | 12/1991 | Germany . |
| 2 272 850 | 11/1993 | United Kingdom . |
| WO 95/16073 | 6/1995 | WIPO . |

*Primary Examiner*—Laura Edwards
*Attorney, Agent, or Firm*—Taylor & Associates, P.C.

[57] ABSTRACT

An apparatus for direct or indirect application of a liquid or pasty medium onto a traveling material web, notably of paper or cardboard, with a support beam which substantially extends in its length direction across the entire width of the material web, is supported in at least two bearing points and includes at least one finish-dosing apparatus. A backing roll opposes the support beam. A relevant bearing point includes two mutually spaced support bars each of which is at its one end jointedly fixed to pivot points of the support beam and at its other end pivotally connected to at least one foundation. At least one prop bar is attached at its one end jointedly to the support beam and is at its other end jointedly fixed to the foundation. A least one of the aforementioned bars is lengthwise adjustable.

20 Claims, 2 Drawing Sheets

APPARATUS AND METHOD FOR DIRECT OR INDIRECT APPLICATION OF A LIQUID OR PASTY MEDIUM ONTO A TRAVELING MATERIAL WEB, NOTABLY OF PAPER OR CARDBOARD

BACKGROUND OF THE INVENTION

1. Field of the Invention

The present invention relates to an apparatus and method for direct or indirect application of a liquid or pasty medium onto a traveling material web, notably of paper or cardboard.

2. Description of the Related Art

Apparatuses and methods as described above are known in multifarious configurations. Prior apparatuses include applicators resting on a support beam and configured either for direct or indirect application of a liquid or pasty coating medium onto a traveling material web or for finish-dosing of a coating medium applied previously onto the material web. The application of the coating medium usually takes place via a pressure chamber with a doctor element, an open-jet nozzle or a comparable other applicator. In the so-called direct application, the coating medium is applied directly onto the traveling material web, supported, e.g., by a backing roll opposing the support beam, while in the indirect application the coating medium is transferred first, e.g., onto an applicator roll opposing the support beam and then, from its surface, onto the material web. In the second case, i.e., with an applicator for finish-dosing, a doctor blade or a comparable other known doctor element is employed to finish-dose the coating substance applied already on the material web, to the desired amount of application. Known from DE 4 130 118 C2 is a categorical apparatus for direct or indirect application of a liquid or pasty medium onto a traveling material web, notably of paper or cardboard, with a support beam that extends lengthwise substantially across the entire width of the material web. The apparatus is supported at two bearing points and includes a finish-dosing apparatus in the form of a doctor blade, a doctor bar or a scraper bar. With this apparatus, the two bearing points rest in two long pivot arms disposed on the outer ends of the support beam, i.e., outside the width of the traveling material web, and serve to pivot the support beam about an axis parallel to the support beam axis to a working position, intermediate position and maintenance position. This type of apparatus, however, not only has the drawback of problematic support beam flexures and comparably low natural frequencies that lead to undesirable resonances, for example, with oscillation frequencies of the pedestal of the apparatus or of the floor of the hall in which the apparatus is installed, but such an apparatus requires additionally a very large, massive and thus heavy and cost-intensive pivoting device. An adaptation to changing operating conditions, such as changing backing roll diameters, wear of the finish-dosing apparatus, change of the coating angle adjustment between finish-dosing apparatus and backing roll, or a change of the finish-dosing apparatus pressure, is possible with this apparatus only at considerable expense and sometimes is not possible at all. Quick pivotal motions of the support beam can be carried out only with the use of powerful and thus expensive actuators, due to the large masses to be moved and the long lever arms.

With conventional apparatuses, furthermore, it has proved to be problematic that, when using doctor blades as finish-dosing apparatus, for one, an adjustment of the blade angle, that is, the angle between the doctor blade and a tangent laid to the opposing applicator roll, by pivoting the support beam leads to an undesirable change of the blade pressure or even to a liftoff of the doctor blade and, for another, a change of the blade pressure leads to an undesirable change of the blade angle and thus to irregularities of the coating profile, which reduces the quality of the finished product.

SUMMARY OF THE INVENTION

The present invention provides a categorical apparatus that avoids the above problems of the prior art and which in an easy and effective manner allows adapting the apparatus to varying operating conditions, notably changing the coating angle or blade angle and the pressure of the finish-dosing apparatus.

Accordingly, each bearing point of the apparatus includes two mutually spaced support bars which at their one end are fixed jointedly to pivot points of the support beam and at their other end are fixed jointedly to at least one foundation. Hence, the support beam comprises totally two support bar pairs, that is, one support bar pair each per bearing point. Additionally, at least one prop bar connects at its one end jointedly to the support beam and is fixed at its other end jointedly on the foundation. Moreover, at least one of the above bars is adjustable in length. Allowance must be made here for the fact that a length adjustment of one of the two support bars of a bearing point is to be understood as a synchronous adjustment of the respective support bar of the two support bars on the other bearing point, so as to avoid a canting of the support beam and to guarantee a uniform adjustment of the support beam. The very same synchronous adjustment is necessary if more than one prop bar is being used. The pivot point, or pivot axis, of the at least one prop bar, in order to achieve a specific desired support beam motion, is preferably spaced from the pivot points of the two support bars, or differs from the pivotal axes of these two support bars. With suitable arrangement of the pivot points and respective pivot axes, of the two support bars, however, the pivot point and respective pivot axis of the at least one prop bar can quite possibly coincide with the pivot point or pivot axis of one of the two support bars.

What is meant by "bars" in the sense of the invention are any transmission members with two pivot points. In the configuration according to the invention, either the two mutually spaced support bars together with the support beam or one of the two support bars together with the at least one prop bar and the support beam form in a lateral view of the applicator sort of a four-bar mechanism where the support beam serves as a linkage member between the support bars, respectively between one support bar per bearing point and the prop bar. At least one of the bars, which may be fashioned as a plain lever or quite possibly also allows lengthwise adjustment, stabilizes this creation which is movable within itself. The overall construction composed of the support bars, the support beam and the at least one prop bar is thus rigid, unless at least one of the bars is adjusted. In a plan view of the support beam, the two support bar pairs form together with the at least one prop bar sort of a tripod. Incidentally, suitable flexible or elastic components or hinges may serve also as joints for the bars.

The apparatus according to the invention allows in an easy and effective manner an adjustment of the applicator of the apparatus to changing operating conditions, enables specifically an easy change of the coating angle (or blade angle, when using a doctor blade as finish-dosing apparatus) and of the finish-dosing apparatus pressure both during operation and standstill. Not only this adjustment of the finish-dosing apparatus, but also a movement of the entire support beam to an operating position, standby position or service respectively maintenance position can be performed universally by merely a single functional component, namely the bars adjustable in length. Saved thereby are involved and costly additional adjustment devices, allowing therefore a simplified and more cost-effective overall construction. Since in a length adjustment, notably in opposite directions, of one or both support bars and the at least one prop bar, a substantially rotary or combined rotary-translatory motion of the support beam about an axis, respectively on a short trajectory near the axis of the least inertial moment of the support beam, is taking place, the adjustment motions can be carried out very quickly and with little expense of power. The at least one prop bar together with one of the support bars assumes a substantial share of the adjustment of the support beam and the components associated with the support beam. Due to its specific design, the apparatus according to the invention provides, with suitable selection of the relevant bar lengths and bar positions and the disposition of the pivot points of the support beam, additionally the possibility of adjusting an extensively selective blade angle of the finish-dosing apparatus, without experiencing in the adjustment process a blade liftoff from the backing roll, an unintended change of the contact pressure or an impermissible flexure of the blade. This guarantees a uniform coating profile and contributes to creating a high-quality finished product. It should be noted that the position of the contact point between the blade tip of a doctor blade used as finish-closing apparatus and the backing roll, that is, the applicator roll, changes slightly in adjusting the blade angle, due to the particular design of the inventional apparatus. However, this does not affect the application of the liquid or pasty medium, since with a suitable selection of component symmetries and component positions the blade tip follows the roll contour in an adjustment and bears always optimally on the backing roll. Realized thereby is an easy adaptation of the apparatus to different roll diameters and to any blade wear. Moreover, the apparatus according to the invention is suited for various types of finish-dosing apparatuses, for example, for doctor bars (e.g., PC-Rollflex®), scraper bars or, when using doctor blades, both for so-called stiff-blade and bent-blade designs. The apparatus is thus able to flexibly adapt to any larger changes or deviations of the blade angle. Hence, the apparatus according to the invention is basically suited for processing most varied types of material web. Unlike the initially named prior art, the inventional apparatus is not limited to arranging the bearing points outside the material web width or outside the length of the support beam. This will be addressed yet in detail hereafter.

According to a design feature of the present invention, the pivot points of the two support bars proximate to the support beam coincide substantially. This configuration is particularly favorable in order to realize the previously described desired movement of the support beam for adjustment of the blade angle and of the contact pressure.

In one embodiment of the invention, the support bars and/or the at least one prop bar, moreover, are designed as actuators adjustable in length. Such actuators, e.g., may be suitable mechanical, hydraulic, pneumatic, electric, electromagnetic actuators and the like, as well as combinations thereof.

A further design variant of the invention provides for making the lengthwise adjustable actuators dependent and/or independent of one another. This makes it possible to perform by a suitable, mutually adjusted movement of individual or several of these actuators a desired movement of the support beam and of the components mounted on it directly or indirectly, notably of the finish-dosing apparatus, such as a doctor blade and the like, relative to a backing roll opposing the support beam.

It has proved to be advantageous for the inventional apparatus to comprise additionally at least one monitoring and/or control and/or regulating system for controlled adjustment of the lengthwise adjustable bars respectively actuators. When used, a regulating system includes an automatic closed loop which on account of measured values, for example, of the blade angle, contact pressure, cross profile or other properties of the liquid or pasty medium applied on the backing roll, adjusts notably the finish-dosing apparatus, that is, the blade angle and, as the case may be, the contact pressure of the doctor blade, by suitable adjustment of the lengthwise adjustable actuators, and thus by a movement of the support beam. This allows a rapid adaptation of the applicator of the apparatus to changed conditions and avoids additionally extended downtime. The inventional monitoring and/or control and/or regulating system may furthermore comprise components that allow also a manual, automatic or remote actuation of the actuators. If needed, it enables furthermore a centralized regulation and control-related linkage of the lengthwise adjustable actuators to other components of the apparatus.

According to a further design feature of the invention, the at least one jointed mounted prop bar, based on the length direction of the support beam, is disposed in the beam center. According to another design variant, the at least one jointedly mounted prop bar, based on the length direction of the support beam, may be disposed, however, also asymmetric to the support beam center. The movable creation formed by the two jointedly mounted support bars and the support beam allows thereby an especially easy stabilization and allows keeping the support beam clearance across its entire longitudinal expanse at a constant value relative to the opposing backing roll.

Another inventional modification calls for providing the at least one jointedly mounted prop bar in at least one bearing point. When using merely one prop bar, an arrangement asymmetric to the support beam center is thus concerned here. This allows as well a very stable and rigid fixing of the support beam and an exact positioning relative to the opposing backing roll. Furthermore, the prop bar is in this position also accessible with ease and easy to service, due to its proximity to the lateral support beam ends.

A doctor beam has been found to be particularly favorable as finish-dosing apparatus for the inventional apparatus. As mentioned already above, however, not only different doctor blade designs, such as stiff-blade and bent-blade designs, may be successfully employed in the apparatus according to the invention, but also various other finish-dosing apparatuses, such as doctor bars or the like.

Furthermore, the invention provides for disposing the bearing points of the support beam in its longitudinal direction at a distance from its two lateral ends within the longitudinal beam expanse. This arrangement of the support beam bearing points reduces with equal cross sections and wall thicknesses the support beam flexure as compared to conventional designs. Furthermore, the natural frequency of the support beam is with this inventional solution higher than in conventional configurations. Resulting thereof is a greater spacing of the natural frequency of the support beam from the oscillation frequencies, e.g., of the machine foundation and the floor of the hall on which the applicator rests, so that a resonant oscillation in the support beam is dependably prevented. Resulting from the higher natural frequency is also a greater flexibility with respect to the support beam design.

In another embodiment of the invention, the two bearing points of the support beam are in the longitudinal beam direction disposed symmetric to the beam center. If suitable in keeping with constructional circumstances, the two bearing points may in a further embodiment of the invention be disposed, in the longitudinal beam direction, however, asymmetric to the beam center.

In yet another embodiment of the invention, the distances of the bearing points from the longitudinal beam ends amount each to 15–30% of the beam length. The distances of the bearing point to the adjacent beam ends may be equal or different, so that a symmetric or asymmetric arrangement of the bearing points is concerned. In a preferred embodiment with bearing points disposed symmetrically relative to the beam center, the distance between bearing point and lateral beam end ranges in view of a minimal beam flexure within a length range of about 22–25% of the support beam length.

A further embodiment of the invention consists in equipping the support beam with a flexure compensating apparatus known as such, which may be a configuration based on thermal, pneumatic or hydraulic compensation, but similarly also on a different principle of compensation, for example, a configuration based on magnetic, inductive or mechanical compensation. For example, a suitable solution consists in providing tie rods or thrust rods extending in length direction of the support beam and actuated by way of traction respectively thrust devices for compensation of undesirable flexures. Since the higher natural frequency in the inventional solution allows a reduction of the support beam wall thickness, also the flexure compensation apparatus may be dimensioned smaller as compared to a conventional design, because the support beam with the reduced wall thickness allows an easier compensation of its flexure. With both the reduced wall thickness of the support beam and the less expensively designed flexure compensation apparatus, a more lightweight support beam is obtained with the invention. Hence, the inventional solution also allows a less expensive realization. The cross-sectional shape of the support beam may be chosen, depending on design circumstances, triangular, polygonal, round or in any other suitable way.

A process step according to the invention includes a mutually independent and/or dependent controlled length adjustment of at least one of the support bars of the apparatus per bearing point or of the at least one prop bar for adjustment of a coating angle or blade angle between the finish-dosing apparatus and the backing roll opposing the apparatus and/or of a contact pressure exerted by the finish-dosing apparatus on said backing roll and/or for moving the support beam to an operating position, intermediate position or service position. An adjustment of the various bars may be carried out in the sense of the invention also sequentially.

Accordingly, a single bar length adjustment (with the support bars always based on a relevant bearing point of the support beam) can perform several functions, that is, the aforementioned adjustment of the coating angle, respectively blade angle, of the finish-dosing apparatus, the change of the contact pressure of the finish-dosing apparatus or a movement of the support beam to an operating position, intermediate position or maintenance position. In addition, the method according to the invention offers the advantages explained already in conjunction with the inventional apparatus.

A further process step of the inventional method provides for a movement of the support beam on a predetermined trajectory by means of mutually independent and/or dependent, controlled length adjustment of the two support bars of a relevant bearing point of the support beam. With a simultaneous adjustment of both support bars per bearing point, wherein said adjustment quite possibly may differ, the length of the at least one prop bar—be it lengthwise adjustable or not—is kept constant.

According to another embodiment of the inventional method, moreover, a process step is provided for in which the support beam is moved along a predetermined trajectory by means of independent and/or dependent, controlled length adjustment of at least one of the two support bars per bearing point and of the at least one prop bar. Extended in this way can be the freedom of movement of the support beam. When adjusting in this process step only one of the two support bars per bearing point, the length of the not actuated support bar—be it length-adjustable or not—remains constant. Suitable selection of the lengths and arrangement of the bars of the apparatus makes it possible to affect the trajectory in such a way that it shrinks merely to a point, that is, the support beam substantially rotates. An adjustment of both the two support bars and the at least one prop bar is covered as well by this process step. The relevant adjustment movements may be equidirectional and/or counter-directional.

Another embodiment variant of the method according to the invention provides for moving the support beam on a predetermined trajectory by means of independent and/or dependent, controlled length adjustment of at least one of the two support bars per bearing point and of the at least one prop bar.

Depending on application, the support beam may be moved also by means of mutually independent and/or dependent, controlled length adjustment of the two support bars per bearing point on a predetermined trajectory.

Moreover, according to a further embodiment of the inventional method the movement of a support beam (2) and the change of the coating angle is effected only by controlled length adjustment of the prop bar, so that the finish-closing apparatus follows in the movement of the support beam and in changing the coating angle substantially exactly the contour of the backing roll.

The applicability of the process steps described above, naturally, depends on the respective configuration of the inventional apparatus.

A further embodiment of the invention provides for regulating the support beam movement automatically by means of suitable regulating devices, the regulation taking place in contingence on a desired coating weight and/or the wear of the finish-dosing apparatus and/or of the backing roll. This allows, in turn, a maximally quick adaptation of the applicator of the apparatus to changed conditions and avoids extended downtime. Moreover, when needed, this measure enables a centralized activation or regulation and control-related linkage of the length-adjustable actuators effecting the support beam movement to other components of the apparatus.

Especially the inventionally provided computer-aided regulation of the support beam movement has proved itself.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
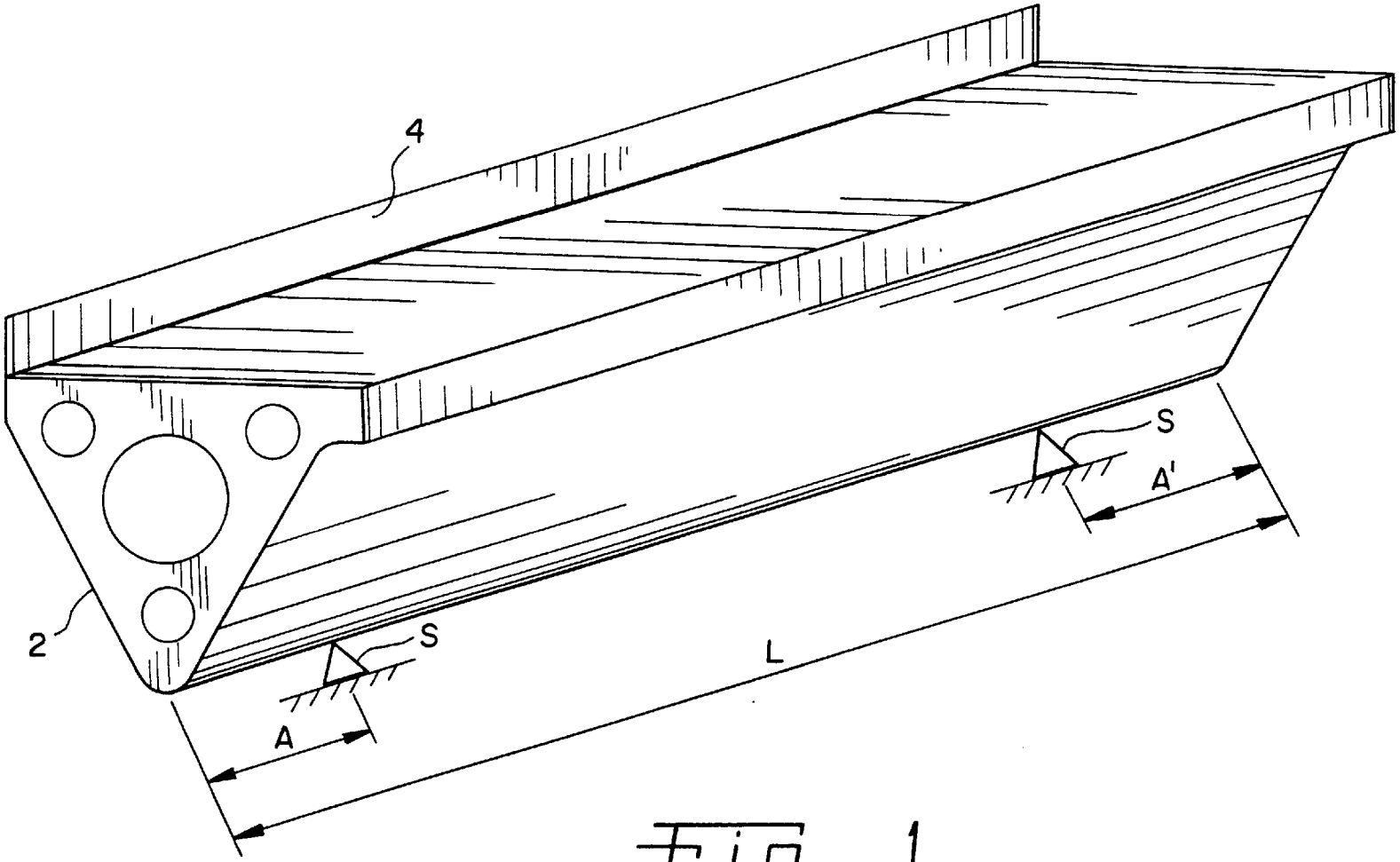
FIG. 1 is a schematic, perspective view of one embodiment of the apparatus of the present invention.

Referring now to the drawings and particularly to FIG. 1, there is shown a schematic perspective illustration a first general exemplary embodiment of an inventional apparatus for direct or indirect application of a liquid or pasty medium onto a traveling material web, notably of paper or cardboard. Opposing a backing roll not illustrated in this figure (which basically may concern both a roll supporting a traveling material web and serving a direct application of a coating medium and also an applicator roll for performance of an indirect application of the coating medium), the apparatus includes a support beam 2 formed by an outer pipe with a closed polygonal cross section, that is, presently a substantially triangular cross section. Basically, however, any other suitable cross section is usable. Fitted inside the outer pipe is an inner pipe with a closed circular cross section, joined integrally to the outer pipe. The inner pipe and additional bulkheads between the inner pipe and the outer pipe subdivide the space between inner pipe and outer pipe in several chambers. This inner structure of support beam 2, which, depending on the relevant application, may quite well deviate from the design described above, is not illustrated in detail in the drawings.

Support beam 2 is supported at two bearing points S, which in FIG. 1 are indicated only strictly schematically and of which the one (the left one in FIG. 1) is fashioned as a fixed bearing and the other (the right one in FIG. 1) as a movable bearing. Bearing points S are in the present case disposed symmetric to the support beam center and backed off inward, from the lateral ends of support beam 2 and toward the center, each by an equal distance A, A'. The ratio of distance A, A' between bearing point S and the adjacent lateral beam end to an overall length L of support beam 2 ranges between 15–30%. In view of a maximally slight beam flexure, a range of about 22–25% has proved to be particularly suited. In a not illustrated asymmetric arrangement of bearing points S, distance A of the one bearing point from the adjacent lateral beam end may be chosen different from distance A' of the second bearing point relative to its adjacent lateral beam end.

For compensation of the flexure of support beam 2, a liquid, for example water, may be passed through the aforementioned chambers of support beam 2, the passing fluids being variable in their temperature in the individual chambers in such a way that they occasion thermally the compensation of the flexure. A mechanically acting flexure compensation apparatus employing pressure hoses may be used as well for compensation of the beam flexure, as known already from DE 39 25 517 C2.

Figure 2:
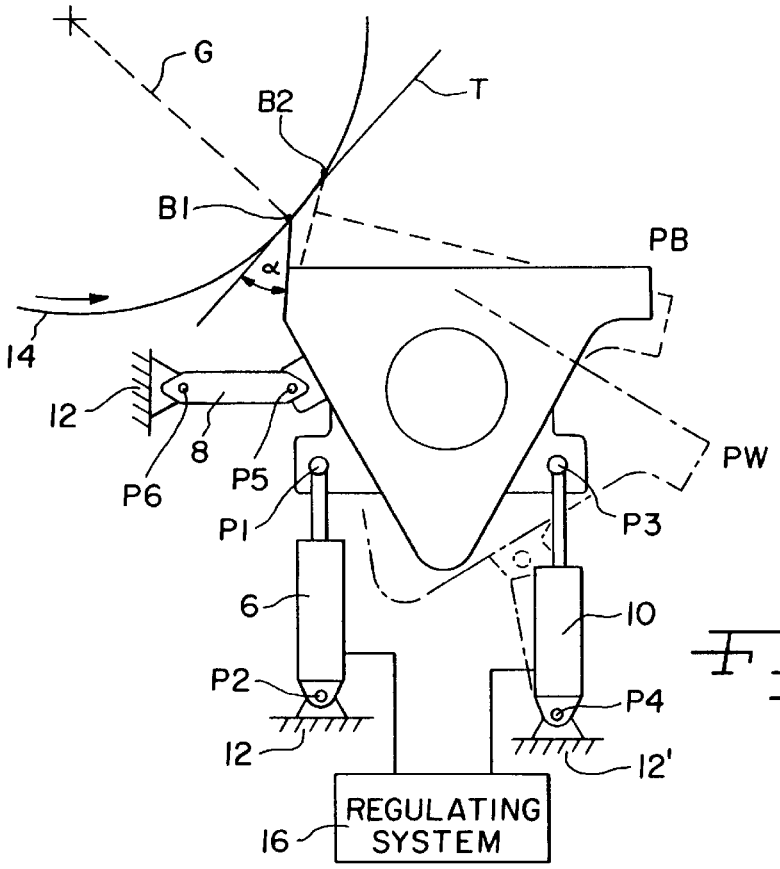
FIG. 2 is a schematic, side view of the apparatus illustrated in FIG. 1, in the region of a bearing point.

FIG. 2 shows in a schematic, side view further details of the inventional apparatus illustrated in FIG. 1 in the region of a bearing point S. As is evident in this drawing, a relevant bearing point S of the apparatus includes two mutually spaced support bars 6 and 8, which presently differ in length and are fixed each with one end jointedly to mutually spaced pivot points P1, P5 of support beam 2 and with their other ead in mutually different points P2 and P6, jointedly, on a foundation 12 of the apparatus, with the pivot point P5 of lever 8, proximate to the support beam, disposed slightly above the upper pivot point P1 of support bar 6. Consequently, the apparatus possesses two support bar pairs, each formed of a support bar 6 and 8. The design and arrangement of support bars 6, 8 being identical for each bearing point S, only the support bars of a single bearing point S are being considered in the following description.

In the embodiment shown in FIG. 2, support bar 6 extends from the left support beam end substantially vertically down, while support bar 8 extends from the left support beam end substantially horizontally to the left and approximately perpendicularly to support bar 6. Support bar 8 is presently fashioned as a plain lever 8 of constant length. An individual prop bar 10, originating from the right-hand support beam end and extending substantially parallel to support lever 6, is with its top end hinged to a pivot point P3 that is spaced from pivot point P1 of support bar 6, on the right-hand side of support beam 2, and hinges with its bottom end in point P4 to foundation 12 of the apparatus or to a further foundation 12'. Basing on the support beam length direction, prop bar 10 is thus disposed asymmetrically, relative to the support beam center, in the region of a single bearing point S. In a plan view of support beam 2, not shown in the drawings, prop bar 10 forms together with support bar pairs 6, 8, provided on two bearing points S, sort of a tripod.

Bottom pivot point P4 of prop bar 10, as compared to bottom pivot point P2 of support bar 6, is disposed slightly lower. Bearing bar 6 and prop bar 10 are in one embodiment fashioned as lengthwise adjustable actuators in the form of hydraulic cylinders 6, 10. It is to be understood, however, that the use of other suitable mechanical, pneumatic, electric, electromagnetic actuators and the like, as well as combinations thereof, is possible as well. Two mutually spaced hydraulic cylinders 6 and 10 form in the lateral view according to FIG. 2, together with support beam 2, sort of a four-bar mechanism, with support beam 2 acting as linkage member between hydraulic cylinders 6 and 10. Movable within itself, this creation is stabilized by lever 8 attaching sideways to support beam 2, so that the overall construction formed of hydraulic cylinders 6, 10, support beam 2 and lever 8 is rigid in itself so long as no length adjustment is made of at least one of hydraulic cylinders 6, 10.

In an operating position PB, illustrated in FIG. 2 with the aid of solid heavy lines, hydraulic cylinders 6, 10 of the apparatus are extended each to different, defined lengths. Of course, this length presetting may from case to case vary considerably, depending on the cylinders used and on their arrangement. Top pivot point P1, P3 of hydraulic cylinders 6, 10 attaching to pivot points P1, P3 of support beam 2 are in this position disposed substantially in an equal horizontal plane, and the longitudinal axes of hydraulic cylinders 6, 10 extend—as mentioned above already—approximately parallel to one another. In this configuration, lever 8 as illustrated in FIG. 2 tilts slightly toward the right and down, in relation to the horizontal, so that right-hand pivot point P5 of lever 8 attaching to pivot point P5 of the left support beam end is disposed, viewed in vertical direction, in a position somewhat lower than left lever pivot point P6. A doctor blade 4 mounted on support beam 2 as finish-dosing apparatus bears in the operating position PB at a given backing roll diameter with a defined contact pressure and a defined blade angle α on a backing roll 14 opposing the apparatus (the direction of rotation of backing roll 14 being indicated by arrow). A contact point B1 between doctor blade 4 and backing roll 14 is located here, in an ideal operating position, on a straight line G through the center of roll 14 and the point of doctor blade 4. Blade angle α, that is, the angle between a tangent T laid in the contact point B1 on backing roll 14 and doctor bar 4, amounts in the operating position PB normally to about 40°, but depends heavily on the doctor blade type currently used and on the doctor blade mounting as well as the liquid or pasty medium being processed, respectively on the material web, in the case of direct application. In the stiff-blade operation, blade angle α ranges usually between about 20–45°, in the bent-blade operation up to about 20°. However, the aforementioned settings are to be understood only as rough reference values.

In order to reduce now, basing on this operating position PB, for example blade angle α, left hydraulic cylinder 6 is extended upward by a specific amount, that is, the length between the pivot points P1, P2 of cylinder 6 is adjusted, causing support beam 2 to turn about pivot point P3 toward the right. But with top pivot point P1 of hydraulic cylinder 6 disposed near right-hand pivot point P5 of lever 8, pivot point P1 migrates in the upward extension of cylinder 6 as well slightly to the right and up, causing support beam 2 to move overall along a predetermined trajectory. As indicated in FIG. 2 by dashed lines, contact point B1 between doctor blade 4 and backing roll 14 migrates in such adjustment motion slightly upward counterclockwise until reaching a new operating point, i.e., a contact point B2. But this migration of the contact point does not affect the application process because with a suitable selection of the lengths respectively extensions and the arrangement of hydraulic cylinders 6, 10 and of lever 8 the predetermined trajectory can be chosen so optimally that the blade point of doctor blade 4 follows the contour of backing roll 14 and, while blade angle α is being reduced, the contact pressure of doctor blade 4 against backing roll 14 does not increase.

The procedure is exactly the opposite for enlargement of blade angle α.

When now with a blade angle α remaining constant desiring to raise the contact pressure of doctor blade 4 against backing roll 14, a combined—i.e., here also a mutually dependent—adjusting motion of the two hydraulic cylinders 6, 10 is effected, with the right-hand hydraulic cylinder 10 being slightly extended and the left-hand hydraulic cylinder 6 slightly retracted. Depending on configuration of the inventional apparatus, the point of contact B1 between the blade tip of doctor blade 4 and backing roll 14 may change thereby, the same as in the previously explained blade angle adjustment. Generally, also a length adjustment of already one of the hydraulic cylinders 6, 10 may under certain prerequisites be sufficient for changing blade angle α and/or the contact pressure. In changing one of these parameters, however, also the second parameter will mostly change in this type of adjustment, due to the kinematic linkage of the individual apparatus components. As long as influencing the second parameter is of no significance, as in a brief liftoff of doctor blade 4 from backing roll 14 to permit a material web splice to pass, this method of adjustment may very well be used. Otherwise, the aforementioned combined adjusting movement of both hydraulic cylinders 6, 10 can also be used.

A reduction of the contact pressure, analogously, takes place conversely.

Naturally, also a simultaneous change of blade angle α and of the contact pressure is possible by mutually balanced adjustment of hydraulic cylinders 6, 10.

In order to move support beam 2, starting from operating position PB, via an intermediate position to a maintenance or standby position PW, it is normally sufficient to retract right-hand hydraulic cylinder 10, that is, shorten the length between two pivot points P3 and P4. Starting from the aforementioned operating position, support beam 2 moves then along a predetermined trajectory to the maintenance position PW indicated in FIG. 2 by dash-dot line. If necessary, of course, also left hydraulic cylinder 6 may in this process be adjusted simultaneously, thus carrying out a combined adjustment motion.

The procedure is reversed for raising support beam 2 from maintenance position PW to operating position PB.

The inventional apparatus includes a computer-aided control and regulating system 16 for controlled adjustment of length-adjustable hydraulic cylinders 6, 10. This system features an automatic closed loop which on account of measured values, for example, blade angle α, the contact pressure of doctor blade 4 against roll 14, the cross profile or other properties of the liquid or pasty medium applied onto backing roll 14, readjusts blade angle α and/or the contact pressure of doctor bar 4 by suitable length adjustment of hydraulic cylinders 6, 10, and thus also by a movement of support beam 2. Moreover, the control and regulating system includes components (not shown) that also allow a manual or remote actuation of the actuators, for instance via a control panel, a central computer or the like, in order to move support beam 2, e.g., from its operating position PB to maintenance position PW and vice versa.

Figure 3:
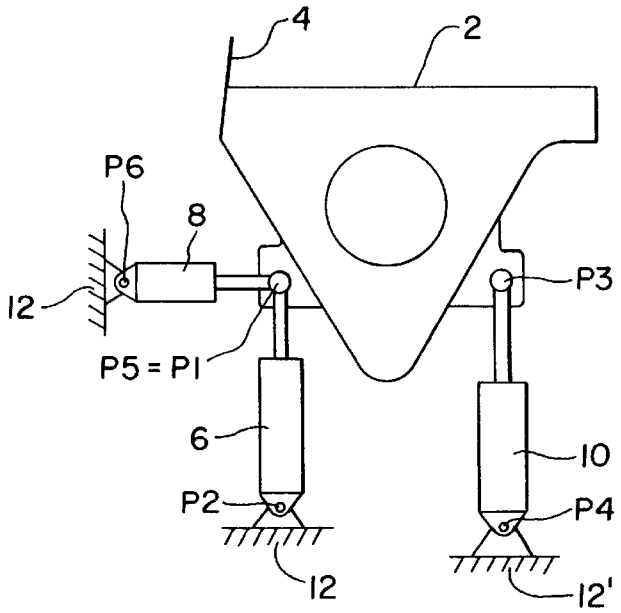
FIG. 3 is a schematic, side view of another embodiment of the apparatus of the present invention.

In a side view comparable to FIG. 2, FIG. 3 shows a schematic illustration of another embodiment of the apparatus according to the invention. In this variant, support bar 8 provided at each bearing point S, which in the embodiment according to FIG. 2 is simply a lever of constant length, is now of a lengthwise adjustable design. Moreover, support bar 8 is with its one end hinged to support beam 2 in such a way that pivot axis P5 of support bar 8, proximate to support beam 2, coincides with the pivot axis of left pivot point P1 of support beam 2, and thus also with pivot point P1 of support bar 6 proximate to support beam 2. Length-adjustable support bar 8, in turn, is with its other end jointedly fixed to one side of foundation 12. Otherwise, this apparatus corresponds substantially to the one shown in FIG. 2, so that further explanations thereto are dispensable. In the apparatus relative to FIG. 3, support beam 2 possesses, due to the additional length adjustability of support bar 8, a further degree of freedom, so that in case of need an even more differentiated motion of support beam 2 and doctor bar 4 mounted on it can be performed. Also installation tolerances or the like caused by positional inaccuracies of support beam 2 or of components associated with it, such as doctor bar 4, can be evened out easily with the aid of length-adjustable support bar 8, relative to backing roll 14, by a mutually balanced lengthwise preadjustment of support bar 8 at bearing points S.

The invention is not limited to the embodiments illustrated above, which show merely examples. Rather, the apparatus according to the invention can deviate considerably from these variants, depending on application. For example, different bar types or bar types other than those described above may be used in an inventional apparatus, wherein "bar" always is to be understood as a kinematic transmission member with two pivot points. The jointed mounting of the support bars, of the at least one prop bar and of support beam 2 may be effected also by way of other suitable, flexible or elastic components or hinges. Furthermore, both the bar or lever lengths predetermined for a specific position of the apparatus, e.g., the operating position, and also the length changes of the relevant bars or levers that occur in a length adjustment may differ from one another. In addition, more than one prop bar 10 may be provided. Possible here is the installation of one prop bar per bearing point S. Besides, the individual bars may assume suitable arrangements relative to one another other than those explained above and illustrated in the drawings. Thus, it is possible, e.g., that support bar 6 and prop bar 10 intersect in X-fashion in a view as illustrated in FIG. 2 and 3. Furthermore, the adjustment velocities of the individual bars may differ from one another. In addition to the example of an indirect application of a liquid or pasty medium, as illustrated above, the inventional apparatus and inventional method are additionally suited also for direct application of the said medium.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An apparatus for one of direct and indirect application of a coating medium onto a traveling fiber material web having a width, said apparatus comprising:

a support beam having a length which extends substantially across the width of the fiber material web, sail support beam including at least two bearing points spaced along said length of said support beam;

at least one finish-dosing apparatus carried by said support beam;

a backing roll disposed adjacent to and coacting with said support beam; and a plurality of bars for interconnecting said support beam with a fixed structure, each of said plurality of bars having a length, said plurality of bars including:

two support bars associated with each said bearing point, each said support bar including one end which is pivotally connected with said support beam at a respective said bearing point via a respective pivot point and another end configured for pivotal connection with the fixed structure; and at least one prop bar, each said prop bar including one end which is pivotally connected with said support beam and another end configured for pivotal connection with the fixed structure;

wherein said length of at least one of said plurality of bars is adjustable.

2. The apparatus of claim 1, wherein said at least one finish-dosing apparatus comprises a doctor bar.

3. The apparatus of claim 1, wherein said length of said support beam includes a center, said at least one prop bar being disposed approximately at said center of said support beam.

4. An apparatus for one of direct and indirect application of a coating medium onto a traveling fiber material web having a width, said apparatus comprising:

a support beam having a length which extends substantially across the width of the fiber material web, said support beam including at least two bearing points;

at least one finish-dosing apparatus carried by said support beam;

a backing roll disposed adjacent to and coacting with said support beam; and a plurality of bars for interconnecting said support beam with a fixed structure, each of said plurality of bars having a length, said plurality of bars including:

two support bars associated with each said bearing point, each said support bar including one end which is pivotally connected with said support beam at a respective said bearing point via a respective pivot point and another end configured for pivotal connection with the fixed structure, said pivot points for each said bearing point substantially coinciding; and at least one prop bar, each said prop bar including one end which is pivotally connected with said support beam and another end configured for pivotal connection with the fixed structure;

wherein said length of at least one of said plurality of bars is adjustable.

5. An apparatus for one of direct and indirect application of a coating medium onto a traveling fiber material web having a width, said apparatus comprising:

a support beam having a length which extends substantially across the width of the fiber material web, said support beam including at least two bearing points;

at least one finish-dosing apparatus carried by said support beam;

a backing roll disposed adjacent to and coacting with said support beam; and a plurality of bars for interconnecting said support beam with a fixed structure, each of said plurality of bars having a length, said plurality of bars including:

two support bars associated with each said bearing point, each said support bar including one end which is pivotally connected with said support beam at a respective said bearing point via a respective pivot point and another end configured for pivotal connection with the fixed structure; and at least one prop bar, each said prop bar including one end which is pivotally connected with said support beam and another end configured for pivotal connection with the fixed structure;

wherein said length of at least one of said plurality of bars is adjustable, and at least one of said plurality of bars comprises a lengthwise adjustable actuator.

6. The apparatus of claim 5, wherein said at least one lengthwise adjustable actuator comprises a plurality of lengthwise adjustable actuators, and wherein said lengthwise adjustable actuators are adjustable one of dependently and independently of each other.

7. The apparatus of claim 5, further comprising at least one of a monitoring system, a control system and a regulating system for controlled adjustment of each said lengthwise adjustable actuator.

8. An apparatus for one of direct and indirect application of a coating medium onto a traveling fiber material web having a width, said apparatus comprising:

a support beam having a length which extends substantially across the width of the fiber material web, said length of said support beam including a center, said support beam including at least two bearing points;

at least one finish-dosing apparatus carried by said support beam;

a backing roll disposed adjacent to and coacting with said support beam; and a plurality of bars for interconnecting said support beam with a fixed structure, each of said plurality of bars having a length, said plurality of bars including:

two support bars associated with each said bearing point, each said support bar including one end which is pivotally connected with said support beam at a respective said bearing point via a respective pivot point and another end configured for pivotal connection with the fixed structure; and at least one prop bar arranged asymmetric to said center of said support beam, each said prop bar including one end which is pivotally connected with said support beam and another end configured for pivotal connection with the fixed structure;

wherein said length of at least one of said plurality of bars is adjustable.

9. An apparatus for one of direct and indirect application of a coating medium onto a traveling fiber material web having a width, said apparatus comprising:

a support beam having a length which extends substantially across the width of the fiber material web, said support beam including at least two bearing points;

at least one finish-dosing apparatus carried by said support beam;

a backing roll disposed adjacent to and coacting with said support beam; and a plurality of bars for interconnecting said support beam with a fixed structure, each of said plurality of bars having a length, said plurality of bars including:

two support bars associated with each said bearing point, each said support bar including one end which is pivotally connected with said support beam at a respective said bearing point via a respective pivot Doint and another end configured for pivotal connection with the fixed structure; and at least one prop bar, each said prop bar including one end which is pivotally connected with said support beam and another end configured for pivotal connection with the fixed structure, each said at least one prop bar being disposed at a corresponding said bearing point;

wherein said length of at least one of said plurality of bars is adjustable.

10. An apparatus for one of direct and indirect application of a coating medium onto a traveling fiber material web having a width, said apparatus comprising:

a support beam having a length which extendsr substantially across the width of the fiber material web, said support beam including two lateral ends, said support beam including at least two bearing points disposed at a distance from a respective said lateral end;

at least one finish-dosing apparatus carried by said support beam;

a backing roll disposed adjacent to and coacting with said support beam; and a plurality of bars for interconnecting said support beam with a fixed structure, each of said plurality of bars having a length, said plurality of bars including:

two support bars associated with each said bearing point, each said support bar including one end which is pivotally connected with said support beam at a respective said bearing point via a respective pivot point and another end configured for pivotal connection with the fixed structure; and at least one prop bar, each said prop bar including one end which is pivotally connected with said support beam and another end configured for pivotal connection with the fixed structure;

wherein said length of at least one of said plurality of bars is adjustable.

11. The apparatus of claim 10, wherein said length of said support beam includes a center, and wherein said two bearing points are disposed symmetric to said center of said support beam.

12. The apparatus of claim 10, wherein said length of said support beam includes a center, and wherein said two bearing points are disposed asymmetric to said center of said support beam.

13. An apparatus for one of direct and indirect application of a coating medium onto a traveling fiber material web having a width, said apparatus comprising:

a support beam having a length which extends substantially across the width of the fiber material web, said support beam including two lateral ends and two bearing points located at respective distances from said lateral ends, said distances each being between approximately 15 and 30 percent of said length of said support beam;

at least one finish-dosing apparatus carried by said support beam;

a backing roll disposed adjacent to and coacting with said support beam; and a plurality of bars for interconnecting said support beam with a fixed structure, each of said plurality of bars having a length, said plurality of bars including:

two support bars associated with each said bearing point, each said support bar including one end which is pivotally connected with said support beam at a respective said bearing point via a respective pivot point and another end configured for pivotal connection with the fixed structure; and at least one prop bar, each said prop bar including one end which is pivotally connected with said support beam and another end configured for pivotal connection with the fixed structure;

wherein said length of at least one of said plurality of bars is adjustable.

14. An apparatus for one of direct and indirect application of a coating medium onto a traveling fiber material web having a width, said apparatus comprising:

a support beam having a length which extends substantially across the width of the fiber material web, said support beam including two lateral ends and two bearing points located at respective distances from said lateral ends, said distances each being between approximately 22 and 25 percent of said length of said support beam;

at least one finish-dosing apparatus carried by said support beam;

a backing roll disposed adjacent to and coacting with said support beam; and a plurality of bars for interconnecting said support beam with a fixed structure, each of said plurality of bars having a length, said plurality of bars including:

two support bars associated with each said bearing point, each said support bar including one end which is pivotally connected with said support beam at a respective said bearing point via a respective pivot point and another end configured for pivotal connection with the fixed structure; and at least one prop bar, each said prop bar including one end which is pivotally connected with said support beam and another end configured for pivotal connection with the fixed structure;

wherein said length of at least one of said plurality of bars is adjustable.

15. A method for one of direct and indirect application of a coating medium onto a traveling fiber material web having a width, comprising the steps of:

providing a support beam having a length which extends substantially across the width of the fiber material web, said support beam including at least two bearing points spaced alone said length of said support beam, said support beam movable between a plurality of positions including an operating position, an intermediate position and a maintenance position,;

providing at least one finish-dosing apparatus carried by said support beam;

providing a backing roll disposed adjacent to and coacting with said support beam, said backing roll and said finish dosing apparatus defining a coating angle and a contact pressure therebetween;

providing a plurality of bars for interconnecting said support beam with a fixed structure, each of said plurality of bars having a length, said plurality of bars including:

two support bars associated with each said bearing point, each said support bar including one end which is pivotally connected with said support beam at a respective said bearing point via a respective pivot point and another end configured for pivotal connection with the fixed structure; and at least one prop bar, each said prop bar including one end which is pivotally connected with said support beam and another end configured for pivotal connection with the fixed structure; and adjusting said length of at least one of said plurality of bars to effect at least one of:

adjustment of said coating angle;

adjustment of said contact pressure; and movement of said support beam to one of said plurality of positions of said support beam.

16. The method of claim 15, comprising the further step of moving said support beam along a predetermined trajectory by adjusting said lengths of said two support bars.

17. The method of claim 15, comprising the further step of moving said support beam along a predetermined trajectory by adjusting said lengths of at least one of said two support bars and said at least one prop bar.

18. The method of claim 15, comprising the further step of moving said support beam and changing said coating angle by adjusting said length of one of said support bars, so that said finish-dosing apparatus follows a contour of said backing roll.

19. A method for one of direct and indirect application of a coating medium onto a traveling fiber material web having a width, comprising the steps of:

providing a support beam having a length which extends substantially across the width of the fiber material web, said support beam including at least two bearing points, said support beam movable between a plurality of positions including an operating position, an intermediate position and a maintenance position;

providing at least one finish-dosing apparatus carried by said support beam;

providing a backing roll disposed adjacent to and coacting with said support beam, said backing roll and said finish dosing apparatus defining a coating angle and a contact pressure therebetween;

providing a plurality of bars for interconnecting said support beam with a fixed structure, each of said plurality of bars having a length, said plurality of bars including:

two support bars associated with each said bearing point, each said support bar including one end which is pivotally connected with said support beam at a respective said bearing point via a respective pivot point and another end configured for pivotal connection with the fixed structure; and at least one prop bar, each said prop bar including one end which is pivotally connected with said support beam and another end configured for pivotal connection with the fixed structure;

adjusting said length of at least one of said plurality of bars to effect at least one of:

adjustment of said coating angle;

adjustment of said contact pressure; and movement of said support beam to one of said plurality of positions of said support beam; and moving said support beam by automatic regulation, said automatic regulation being dependent upon at least one of a desired coating weight, a wear of said finish-dosing apparatus and a wear of said backing roll.

20. The method of claim 19, wherein said automatic regulation of said moving step is carried out using a computer.

* * * * *

UNITED STATES PATENT AND TRADEMARK OFFICE

CERTIFICATE OF CORRECTION

PATENT NO. : 5,958,513

DATED : September 28, 1999

INVENTOR(S) : Zygmunt Madrzak

It is certified that error appears in the above-identified patent and that said Letters Patent is hereby corrected as shown below:

COLUMN 11

Line 38, claim 1, delete "sail" and substitute --said-- therefor.

COLUMN 13

Line 38, claim 9, delete "Doint" and substitute --point-- therefor.

Signed and Sealed this

Third Day of April, 2001

Nicholas P. Godici

*Attest:*

NICHOLAS P. GODICI

*Attesting Officer*

*Acting Director of the United States Patent and Trademark Office*